US006866445B2

(12) United States Patent
Semler

(10) Patent No.: US 6,866,445 B2
(45) Date of Patent: Mar. 15, 2005

(54) SCREED SKI AND SUPPORT SYSTEM AND METHOD

(76) Inventor: Paul M. Semler, 3045 Dodge Blvd., Tucson, AZ (US) 85716

( * ) Notice: Subject to any disclaimer, the term of this patent is extended or adjusted under 35 U.S.C. 154(b) by 0 days.

(21) Appl. No.: 10/178,600

(22) Filed: Jun. 24, 2002

(65) Prior Publication Data

US 2003/0113164 A1 Jun. 19, 2003

Related U.S. Application Data

(60) Provisional application No. 60/341,700, filed on Dec. 17, 2001.

(51) Int. Cl.[7] ..... E01C 19/26
(52) U.S. Cl. ..... 404/119; 52/678; 425/218
(58) Field of Search ..... 404/119, 75, 97, 404/108, 135, 136; 52/678, 169.5; 425/218

(56) References Cited

U.S. PATENT DOCUMENTS

| | | | | |
|---|---|---|---|---|
| 1,988,746 A | | 1/1935 | Neptune | 72/128 |
| 2,306,671 A | * | 12/1942 | Tamblyn | 52/678 |
| 2,319,526 A | | 5/1943 | Wearn | 72/128 |
| 2,331,949 A | | 10/1943 | Whiteman | 72/128 |
| 2,373,284 A | * | 4/1945 | Autry | 52/678 |
| 2,551,826 A | | 5/1951 | Cox, Sr. | 72/122 |
| 2,586,074 A | | 2/1952 | Memluck | 33/1 |
| 2,873,529 A | | 2/1959 | Hogan et al. | 33/1 |
| 3,006,115 A | * | 10/1961 | Hillberg | 52/365 |
| 3,115,726 A | * | 12/1963 | Sayles | 52/155 |
| 3,255,565 A | * | 6/1966 | Menzel | 52/678 |
| 3,579,938 A | * | 5/1971 | Hanson | 52/365 |
| 4,115,976 A | * | 9/1978 | Rohrer | 52/745.05 |
| 4,228,588 A | | 10/1980 | Horton, Jr. | 33/1 |
| 4,575,985 A | * | 3/1986 | Eckenrodt | 52/677 |
| 4,858,958 A | * | 8/1989 | Harbeke | 285/31 |
| 4,892,439 A | | 1/1990 | Kiefer | 404/119 |
| 4,913,582 A | | 4/1990 | Barrett | 404/119 |
| 4,924,579 A | | 5/1990 | Berendsen | 33/1 |
| 5,173,004 A | | 12/1992 | Fahrenkrog | 404/72 |
| 5,212,919 A | | 5/1993 | Shaw et al. | 52/126.6 |
| 5,400,562 A | * | 3/1995 | Bahr | 52/684 |
| 5,586,416 A | * | 12/1996 | Hess et al. | 52/169.5 |
| 6,089,522 A | * | 7/2000 | Haslem et al. | 248/440 |
| 6,092,960 A | * | 7/2000 | McCallion | 404/70 |
| 6,123,745 A | | 9/2000 | Hess, III et al. | 51/677 |
| 6,178,716 B1 | * | 1/2001 | Chen | 52/678 |

FOREIGN PATENT DOCUMENTS

FR 2549870 A1 * 7/1983 ..... E01C/15/00

* cited by examiner

*Primary Examiner*—Thomas B. Will
*Assistant Examiner*—Raymond W Addie
(74) *Attorney, Agent, or Firm*—Cahill, von Hellens & Glazer P.L.C.

(57) ABSTRACT

A screed ski system includes a plurality of circlip saddles supported by corresponding stakes and a plurality of sections of screed ski tubing is snap-fit into the circlip saddles. After screeding of a first layer of aggregate or plastic material, the screed ski tubing and circlip saddles are removed as a unit. The spacers are optionally placed on the stakes, and the screed ski tubing and circlip saddles are placed as a unit on the spacers to facilitate screeding of a second layer of aggregate or plastic material over the first. Some of the screed ski tubing can be flexible to provide an arcuate screed ski.

2 Claims, 7 Drawing Sheets

SCREED SKI AND SUPPORT SYSTEM AND METHOD

BACKGROUND OF THE INVENTION

This application claims the benefit of prior filed co-pending U.S. provisional application Ser. No. 60/341,700 filed Dec. 17, 2001 entitled "SUPPORT SYSTEM INTERFACE PARTS FOR SCREED SKI" by Paul M. Semler.

The present invention relates generally to screed ski support systems, and more specifically it relates to an improved screed ski support system that increases the accuracy, speed, and economy of screeding aggregate materials. The invention also relates to an improved screed ski support system that is capable of screeding multiple aggregate layers, one over the other. The invention also relates to an improved ski screed support system that is capable of conveniently screeding aggregate layers having arcuate edge boundaries. The invention also relates to an improved screed ski support system that is capable of screeding aggregate layers over existing solid surfaces, including surfaces of cured aggregates. The invention also relates to an improved screed ski support system that is capable of screeding aggregates at steep angles, including 90 degree angles or vertical surfaces.

Quite a variety of other screed ski support systems are known. For example, sometimes "2×4" boards are simply nailed to concrete form stakes. Sometimes wooden stakes are driven into the ground and used to support "2×4"s or metal pipes used as screed skis. Both approaches are inefficient, costly, and time-consuming. Wooden screed skis often are not straight, and often have rough, abrasive surfaces that cause undesirable resistance to moving the screed bar during the screeding operation. Wooden stakes are difficult to drive into the ground and split easily, causing further difficulty. Such wooden components are bulky, and become unusable rather quickly. Sometimes screed ski support systems are comprised of cast or machined "J" hooks mounted via an integral screw clamp to a steel stake which supports a 2×4 screed support (ski) parallel to and normally above the (concrete/sand/or other aggregate material) surface to be screeded. These screed ski support systems also are time-consuming and costly to use, and also are bulky. Quite a variety of other ski support systems also are known, as indicated in U.S. Pat. Nos. 5,173,004, 4,913,582, 2,551,826, 2,331,949, 2,306,671, 2,319,526, 5,212,919, 6,123,745 and 1,988,746.

Perhaps the closest known prior art is shown in U.S. Pat. No. 5,173,004, which discloses a system that provides Y-shaped reusable yokes having stems which are inserted into vertical pipe stakes that have previously been pounded into the ground to a certain level by means of a pounding tool that matches the upper ends of the stakes. A nail extending through a hole in the pounding tool serves as an indicator pin that can be aligned with a horizontal string line. The horizontal pipes are rested in the yokes to serve as screed skis. After the screeding operation, both the reusable yokes and the screed ski pipes are removed.

However, U.S. Pat. No. 5,173,004 has a number of shortcomings. The screed skis and support yokes cannot be retrieved without walking through and/or disturbing the screeded aggregate. The aggregate material disposed at a steep grade cannot be screeded using the system of U.S. Pat. No. 5,173,004 because the screed skis are not anchored to the support yokes and will slide or fall away from them. The aggregate material being screeded may cause a screed skis to be lifted from or "float" above the support yokes on the aggregate material, preventing accurate screeding. If the stakes are not pounded into the ground at a nearly perfect 90 degree angle relative to the longitudinal axis of the screed skis to be placed thereon, the screed ski elevation is not accurate. The system of U.S. Pat. No. 5,173,004 does not have any features which allow for fine adjustment of the support yokes on stakes that have been overdriven into the ground or other surface material which supports the aggregate material to be screeded.

All of the above described prior art screed ski support systems require that the user walk through the screeded material in order to retrieve the screed skis and the stakes or other supports for the screed skis. This, of course, disturbs the finish of the screeded material.

Thus, there remains an unmet need for an improved screed ski system that permits screeding operations to be accomplished more accurately, more rapidly, and more economically than has been achievable by the prior art.

There also remains an unmet need for an improved screed ski system that permits accurate, rapid, and economical screeding of multiple aggregate layers, one over the other.

There also remains an unmet need for an improved screed ski system that permits convenient screeding of aggregate layers having arcuate edge boundaries.

There also remains an unmet need for an improved screed ski system that does not require the user to walk through the screeded material in order to retrieve the screed skis and the stakes or other supports for the screed skis.

There also remains an unmet need for an improved screed ski system that facilitates convenient reusability of the screed skis and screed ski supports.

There also remains an unmet need for an improved screed ski system that is usable for screeding aggregate material on steep slopes.

There also remains an unmet need for an improved screed ski system that can be used to screed multiple layers of aggregate material, one on top of the other, using the same stakes and screed ski and ski support assemblies.

SUMMARY OF THE INVENTION

Accordingly, it is an object of the invention to provide a screed ski system that can be utilized more economically, more rapidly, and more accurately than the prior art.

It is another object of the present invention to provide a screed ski system that provides more convenient, more accurate setting of the elevation of screed skis than the prior art.

It is another object of the present invention to provide a screed ski system that provides faster, more convenient assembly of screed ski arrangements than the prior art.

It is another object of the present invention to provide a screed ski system that provides faster, more convenient, more economical construction of the supports for screed skis than the prior art.

It is another object of the present invention to provide a screed ski system that permits more convenient, more rapid removal of screed skis and screed ski supports from the screeded materials than the prior art.

It is another object of the present invention to provide a screed ski system that permits rapid, convenient removal of screed skis and screed ski supports from the screeded materials without disruption of the screeded materials.

It is another object of the present invention to provide a screed ski system that permits attachment of the same screed ski saddles to either rebar stakes or metal tubing stakes.

It is another object of the present invention to provide a screed ski system that permits accurate, rapid, and economical screeding of multiple aggregate layers, one over the other.

It is another object of the present invention to provide a screed ski system that permits convenient screeding of aggregate layers having arcuate edge boundaries.

It is another object of the present invention to provide a screed ski system that is simple in structure and use and is easily understood by unskilled workers, allowing them to easily accomplished precise assembly of the screed ski system.

It is another object of the invention to provide a screed ski system to overcome the above described shortcomings of the prior art devices.

It is another object of the invention to provide a screed ski system in which the screed skis and stakes are readily available at ordinary building supply stores or the like.

It is another object of the invention to provide a screed ski system in which the stakes do not have to be perfectly perpendicular to the axes of the screed skis supported thereby to avoid causing errors in elevation of the screed skis.

It is another object of the invention to provide a screed ski system that permits convenient, accurate screeding of steeply inclined or even vertical aggregate surfaces.

Briefly described, and in accordance with one embodiment thereof, the invention provides a screed ski system including a plurality of circlip saddles supported by corresponding stakes and a plurality of sections of screed ski tubing is snap-fit into the circlip saddles. After screeding of a first layer of aggregate or plastic material, the screed ski tubing and circlip saddles are removed as a unit. The spacers are optionally placed on the stakes, and the screed ski tubing and circlip saddles are placed as a unit on the spacers to facilitate screeding of a second layer of aggregate or plastic material over the first. Some of the screed ski tubing can be flexible to provide an arcuate screed ski.

In one described embodiment, a screed ski system includes a plurality of stakes anchored in ground material that supports aggregate material which is to be screeded, and a plurality of circlip saddles each supported by a corresponding stake. A plurality of sections of screed ski material are snap-fit into and supported by the various circlip saddles, and a plurality of couplers couple various adjacent ends of the various sections of screed ski material together. Each circlip saddle (2) includes a shank (2C) and a pair of opposed arms (2A) attached to an upper end of the shank such that the arms (2A) form a channel (14) in which a section of the screed ski material can be retained by upper tip portions of the arms (2A). In the described embodiments, each circlip saddle is an integral saddle composed of high density polyethylene material, and each pair of arms forms a semi-circular channel (14) that subtends substantially more than 180 degrees such that a diameter of the channel exceeds a distance between the upper tip portions. The sections of screed ski material are composed of EMT tubing having a diameter that is approximately equal to the diameter of the channel (14) end that is greater than the distance between the upper tips. The shank (2C) includes a lower end having a recess for receiving an upper end portion of one of the stakes, and the stakes are composed of rebar material. The tip portion of each arm (2A) is inwardly, downwardly inclined so as to push the tip portions apart in response to pressing a section of the screed ski material (5) into the channel (14). The channel (14) includes a reduced diameter center portion (2F) symmetrically dividing two frusto-conical surface portions (14A) and (14B) which are tapered so as to allow the circlip saddles to effectively grip a section of screed ski material when the shank (2C) is inclined with respect to a line perpendicular to a longitudinal axis of the screed ski material. In one embodiment, a nut (16) is threaded on to the shank of the circlip saddle, and the nut is captured in an upper enlarged portion (18B) of a cup (18) having a lower portion (18C) that is closed except for small center hole to be used for attaching the cup (18) to a solid surface, including an inclined or vertical solid surface, such that rotating the cup rotates the nut and precisely raises or lowers the circlip saddle (2) relative to the cup. In one described embodiment, the screed ski material and the circlip saddles are removed as a unit wherein the circlip saddles grip and remain connected to the screed ski material as it is removed leaving only the stakes anchored in the surface area.

In one described embodiment, a plurality of spacers (20) are placed on at least some of the plurality of stakes (3), and then the circlip saddles and the screed ski material are placed as a unit on top ends of the plurality of spacers. Then the screed bar is slid along the screed ski material to screed a second layer of aggregate material on the first layer of aggregate material.

In one described embodiment, the stakes are driven into the ground by placing an interface tool on the top end of each stake and pounding the interface tool until a marking feature (51) of the interface tool is aligned with a guide in order to provide a desired elevation for the top end of each stake.

DETAILED DESCRIPTION OF THE PREFERRED EMBODIMENTS

Figure 1:
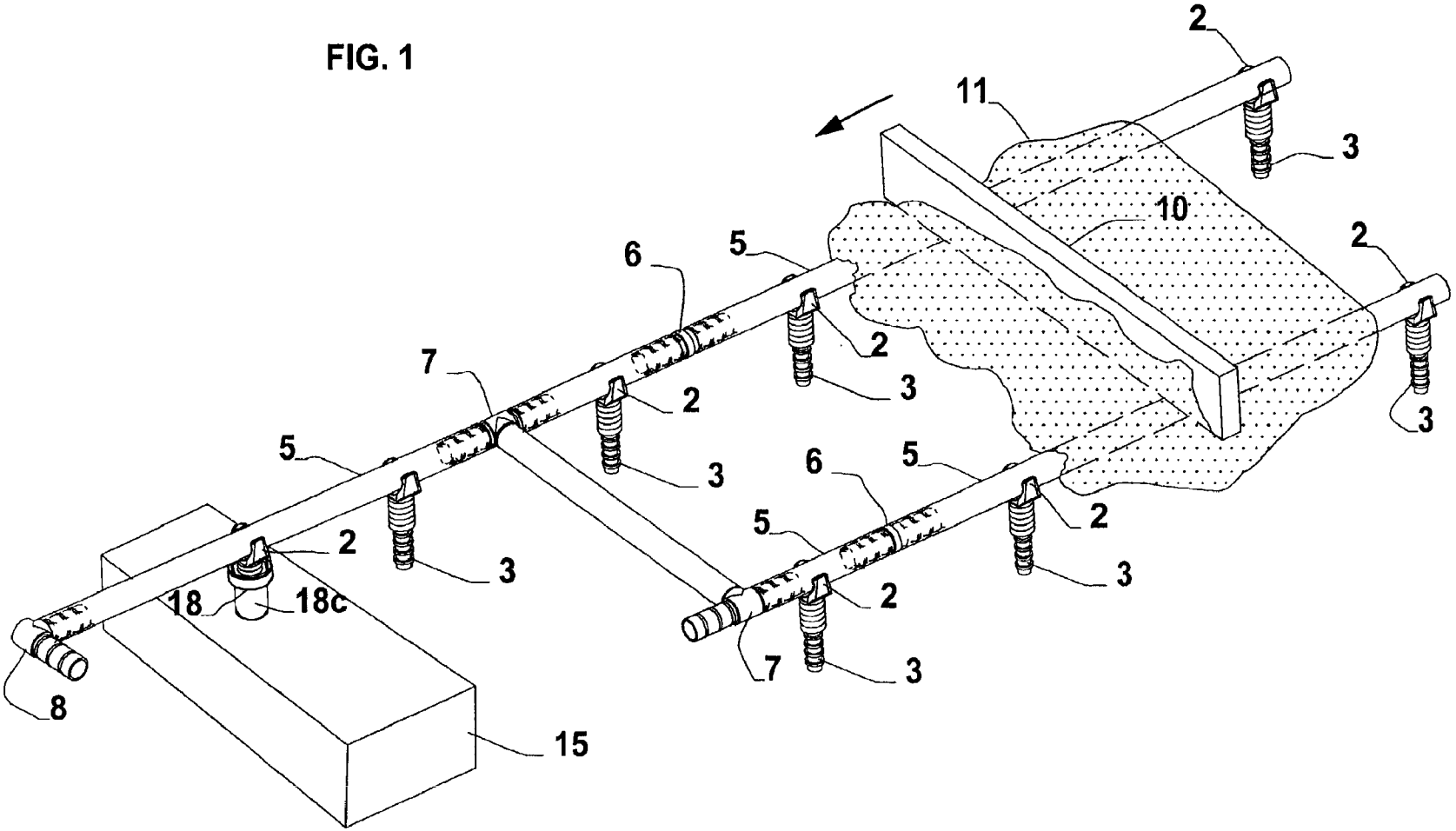
FIG. 1 is a partial perspective view illustrating one embodiment of the screed ski system of the present invention.

Referring to FIGS. 1, 2A, 2B and 2C, the illustrated screed system includes a suitable number of rebar stakes 3 which have been pounded into the ground so that the top of each rebar stake 3 is at a suitable elevation. A circlip saddle 2 is placed on each rebar stake 3 so that the top of each rebar stake 3 extends into the recess 2E in the shank 2C of the circlip saddle 2. A number of sections 5 of standard ¾ inch EMT (electrical metal tubing) tubes are assembled using straight coupler 6 as shown in FIG. 3A, Tee couplers 7 as shown in FIG. 3B, and 90 degree couplers 8 as shown in FIG. 3C so that the assembled EMT tube sections 5 can be snapped onto the various circlip saddles 2 as illustrated. Then screed bar 10 can be slid along the EMT tubes 5 to screed a layer of aggregate material 11.

Figure 2A:
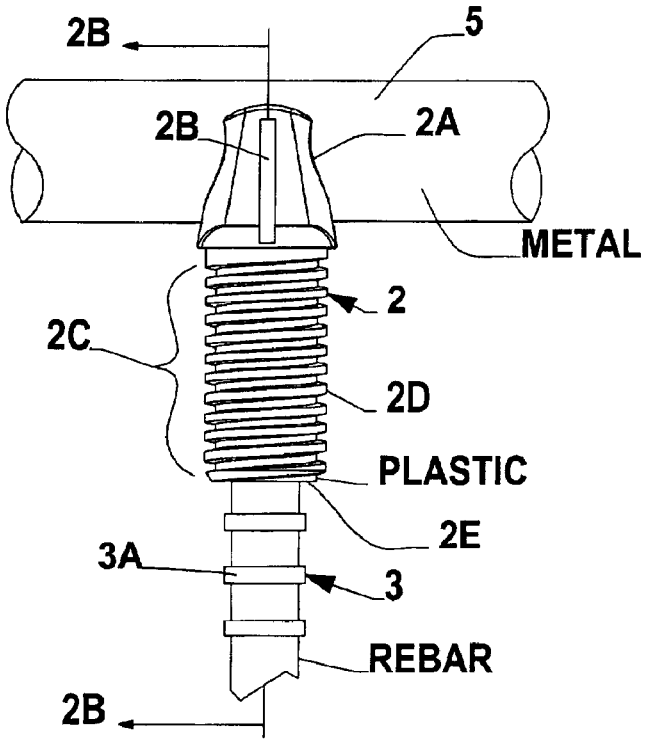
FIG. 2A is elevation in view of a screed ski circlip saddle of the system shown in FIG. 1.
Figure 2B:
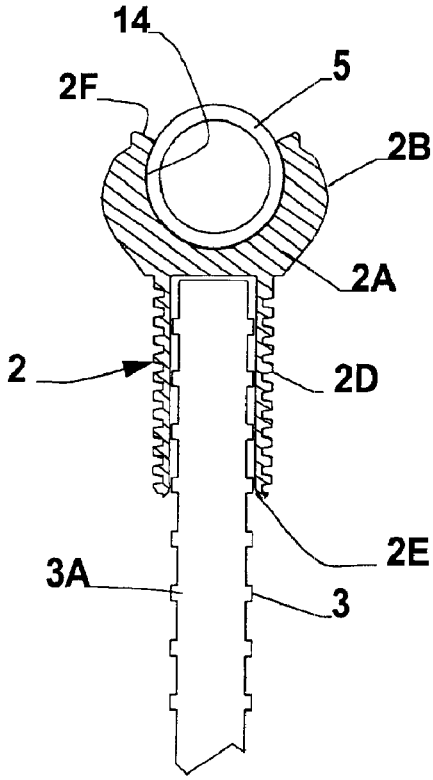
FIG. 2B is a section view a section line 2B—2B of FIG. 2A.
Figure 2C:
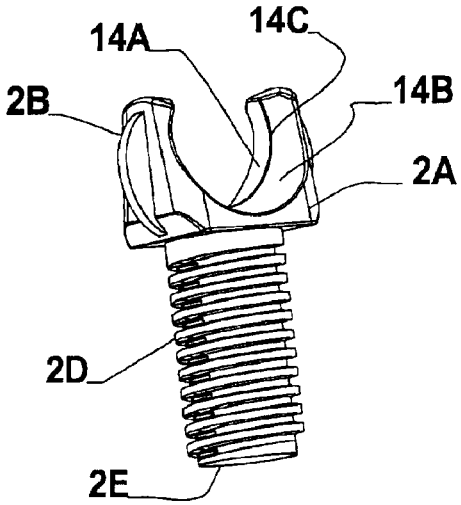
FIG. 2C is a perspective view of the screed ski circlip saddle shown in FIGS. 1, 2A and 2B.
Figure 3A:
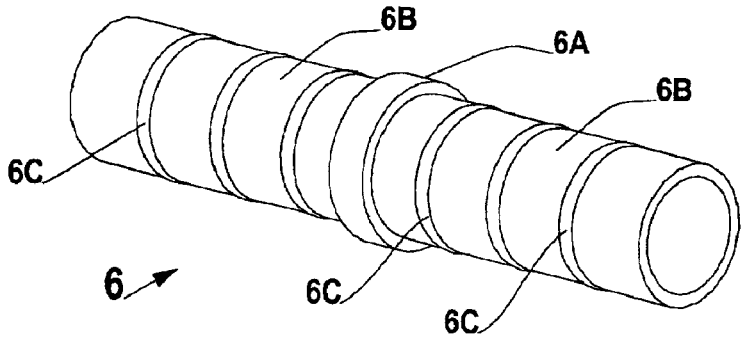
FIG. 3A is a perspective view of the straight coupler used in the embodiment of FIG. 1.
Figure 3B:
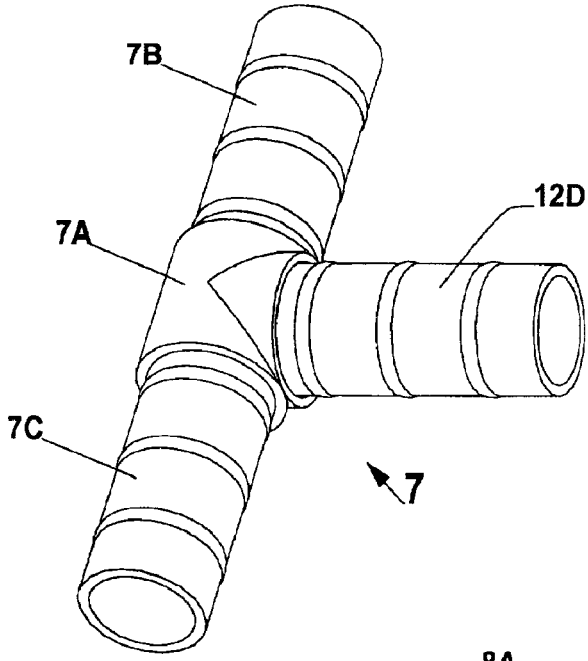
FIG. 3B is a perspective view of a Tee coupler used in the embodiment of FIG. 1.
Figure 3C:
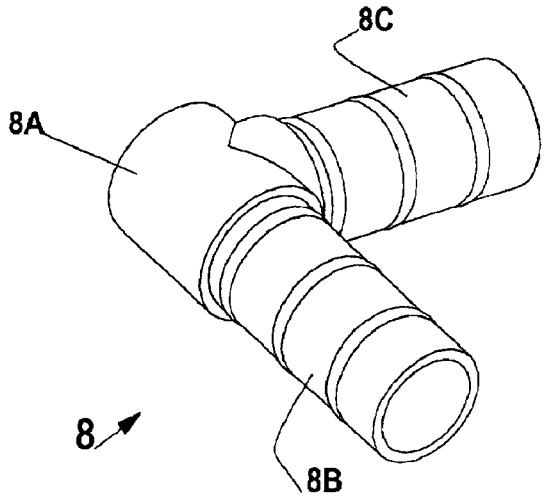
FIG. 3C is a perspective view of a 90 degree coupler used in the embodiment of FIG. 1.

The details of each circlip saddle 2 are shown in FIGS. 2A, 2B and 2C. The circlip saddle 2 includes a hollow base or shank 2C having a bottom opening or recess 2E into which a piece of straight #4 rebar stake 3 can easily fit. Alternatively, the outer surface of shank 2C can easily fit into the inside diameter of a stake comprised of a piece of ¾ inch EMT tube of appropriate length. In the embodiment illustrated in FIGS. 2A, 2B and 2C, the outer surface of shank 2C is surrounded by threads 2D onto which a "captured" hex nut 16 shown in subsequently described FIGS. 6B and 6C is threaded, in order to provide a precise elevation adjustment mechanism.

The upper portion of circlip saddle 2 includes two opposed arms 2A so as to define a semicircular channel 14 into which a section 5 of EMT tube can be snap-fit, as shown in FIGS. 2A and 2B. The semicircular channel 14 subtends an angle of approximately 240 degrees, although other angles greater than 180 degrees also could be used. Consequently, the uppermost tip portions of circlip saddle 2 are closer together than the diameter of ¾ inch EMT tube 5, so when it is pressed downward into channel 14, the uppermost tip portions of arms 2A are forced apart slightly as EMT tube 5 is forced into channel 14 and then resiliently close back against the upper portion of EMT tube 5 so as to retain it in channel 14. That is, the EMT tube 5 can be "snapped into" and retained in channel 14, and can also be "snapped out of" channel 14. Another feature of circlip saddle 2 is that channel 14 includes a center ridge 14C having a slightly shorter radius than the radii of the outer portions of two slightly tapered, symmetrically opposed surfaces 14A and 14B constituting the channel 14 of circlip saddle 2. This feature allows circlip saddle 2 to securely grip a section 5 of screed ski ¾ inch EMT tube even when the longitudinal axis of shank 2C of circlip saddle 2 is inclined by as much as approximately + or −10 degrees with respect to a line perpendicular to the longitudinal axis of the screed ski EMT section 5. This feature is important because it is almost impossible to pound a stake so that it is "perfectly plumb" or at the right ankle to the screed surface. The "tapered" surfaces 14A and 14B allow the stake to be imperfectly pounded into the ground or other support material with a wide range of +/−10 degrees of error and nevertheless support the screed ski EMT tube section 5 at precisely the correct elevation because the center ridge 14C which ultimately supports the screed ski is at precisely the correct elevation.

Preferably, circlip saddle 2 can be composed of high density polyethylene and can be manufactured using inexpensive injection molding techniques. However, various other plastic materials such as ABS plastic, polyvinyl chloride (PVC) and high-density polypropylene (HDPP) can be used instead. A boss 2B is provided on the outer surface of each arm 2A to provide a suitable amount of reinforcement. The outer surface of shank 2C does not have to be threaded if the subsequently described hex nut 16 and cup 18 which "captures" hex nut 16 (see FIGS. 6B and 6C) are not used.

FIGS. 3A, 3B and 3C show the details of the straight coupler 6, Tee coupler 7, and 90 degree coupler 8 that can be used to assemble suitable sections of EMT tube 5 into a configuration that corresponds to the shape of the aggregate material to be screeded.

Referring to FIG. 3A, straight coupler 6 simply joins lengths 5 of the EMT screed ski tube rigidly together, end to end. In one embodiment, straight coupler 6 is a 4.25 inch long hollow high density polyethylene tubular part having two symmetrically opposed end sections 6B which extend outwardly as shown from a central cylindrical hub 6A. The cylindrical outside surfaces of end of sections 6B each have three rounded ridges 6C thereon. The outside diameter of the rounded ridges is 0.825 inches, so as to fit snugly inside standard ¾ inch EMT tube material. The hub 6A provides a stop to limit insertion of each end section 6B into a section 5 of EMT screed ski material. Alternatively, swaged coupling parts could be utilized to connect sections 5 of EMT tube together. In another alternative embodiment, screed ski tubes 5 could be provided with overlapping or otherwise mating ends.

Referring to FIG. 3B, Tee coupler 7 includes a "through portion" including a hub 7A and axially opposed straight sections 7B and 7C extending outwardly in opposite directions from hub 7A and, with third section 7D extending outwardly from hub 7A at a 90 degree angle to sections 7B and 7C. Similarly to above described straight connector 6 in FIG. 3A, sections 7B, 7C and 7D each have three rounded ridges which can be inserted snugly into ¾ inch EMT tubing. Hub 7A acts as a stop to insertion of each of sections 7B, 7C and 7D. Tee coupler 7 also can be composed of high density polyethylene.

Referring to FIG. 3C, 90 degree connector 8 is similarly constructed, including sections 8B and 8C extending perpendicularly with respect to each other from hub 8A.

Figure 4:
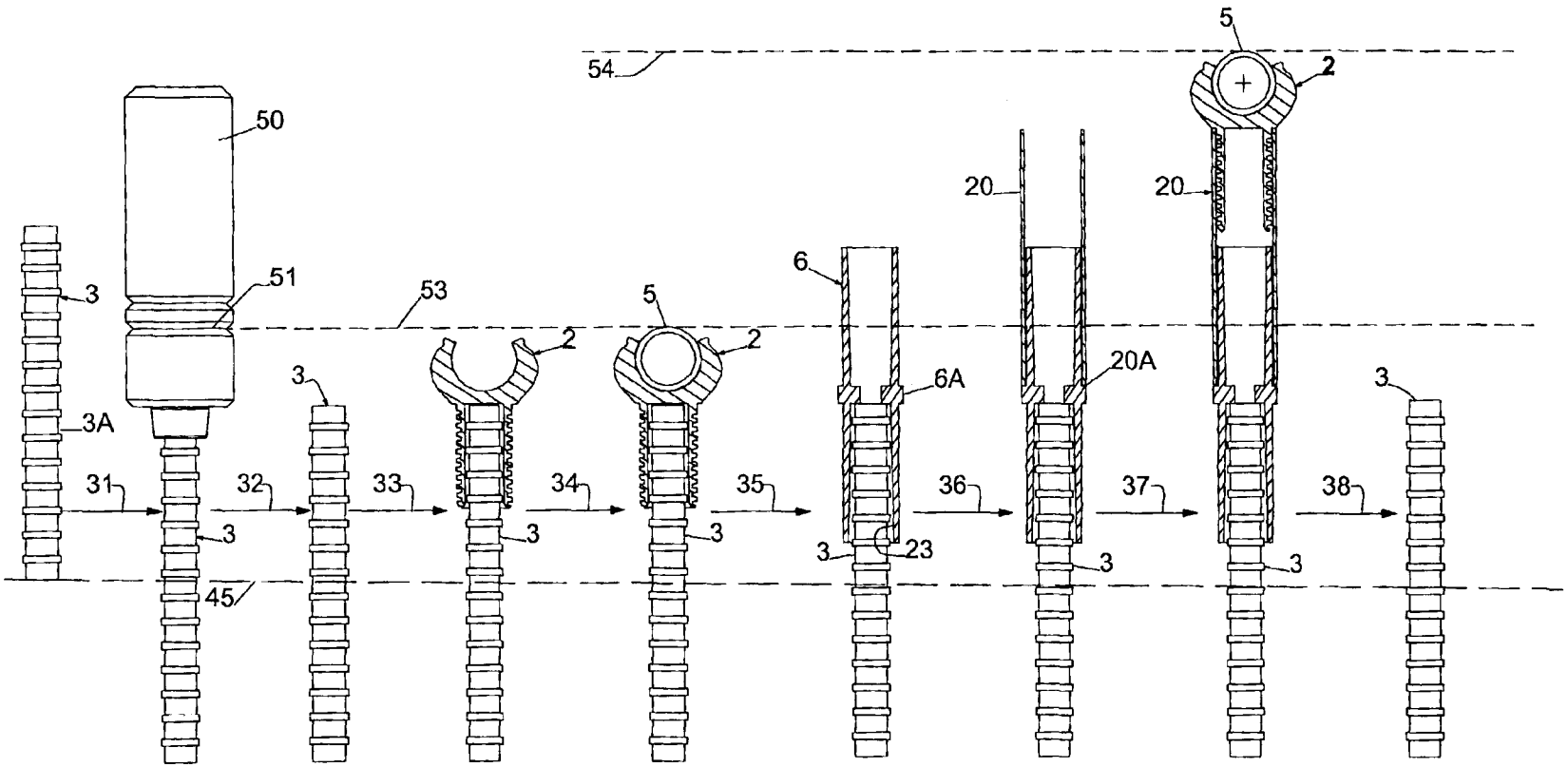
FIG. 4 is a side elevation view illustrating the sequence of steps used in assembling the screed ski system of the present invention.

Referring to FIG. 4, which shows a sequence of steps used in assembling the screed ski system of the present invention, rebar stake 3 has to be precisely pounded into the ground so that its upper end is at a level such that when circlip saddle 2 is placed thereon, and screed ski tube 5 then is snap-fit into channel 14 of circlip saddle 2, the highest point of screed ski tube 5 is at the level indicated by dashed line 53 in FIG. 4, which typically is defined by a taut "string line". Then the screed bar 10 (FIG. 1) can be slid along screed ski 5 at the level of line 53 to define the top of the screeded aggregate material precisely at that level. To accomplish that, the next step, indicated by arrow 31, is to place a cylindrical pounding tool 50 on top of rebar stake 3 so that the upper end of rebar stake 3 extends into a mating recess 52 in the bottom of pounding tool 50. The hammer (not shown) is utilized to pound on the top of pounding tool 50, thereby driving rebar stake 3 into the ground until a circumferential groove 51 around the body of pounding tool 50 is precisely at the level of string line 53. Then, as indicated by arrow 32, pounding tool 50 is removed, and the top end of rebar stake 3 is at the elevation shown. The groove 51 is positioned at a level on pounding tool 50 such that when circlip saddle 2 is then placed on rebar stake 3 as indicated by arrow 33 and screed ski tube 5 is snap-fit into channel 14 of circlip saddle 2 as indicated by arrow 34, the highest point of screed ski tube 5 is at the level indicated by dashed line or taut string line 53.

Then the screed bar 10 can be slid along the screed ski section 5 to screed a first layer of aggregate material. When that task is complete, the complete assembly including all of the screed ski sections 5 and the circlip saddles 2 attached thereto, can be lifted off of the rebar stakes 3 as a unit, whereby the users do not have to walk on the screeded material to retrieve any of the screed ski sections or circlip saddles 2. The screeding job may be finished at that point.

However, if it is desired to place a second layer of aggregate material on the first and then screed the second layer of aggregate material at the level indicated by dashed line 54 in FIG. 4, then a straight coupler 6 can be placed on top of each rebar stake 3, as indicated by arrow 35. The next step, as indicated by arrow 36, is to put a spacer sleeve 20 over the upper end of each straight coupler 6. Then, as indicated by arrow 37, the entire assembly including the same screed ski EMT tube sections 5 and the circlip saddles 2 attached thereto that were removed as a unit after the screeding of the first aggregate layer now can be placed on the spacer sleeves 20 so that the shank of each circlip saddle 2 extends into the open upper end of a corresponding spacer sleeve 20. The second layer of aggregate material can be screeded at the level indicated by dashed line 54 by sliding the screed bar 10 along the elevated screed ski tube sections 5. When the screeding of the second aggregate layer is complete, the assembly including the screed ski tube 5 and the circlip saddles 2 can also can be removed as a unit, as indicated by arrow 38, leaving only the original rebar stakes 3 permanently in the ground.

Figure 5:
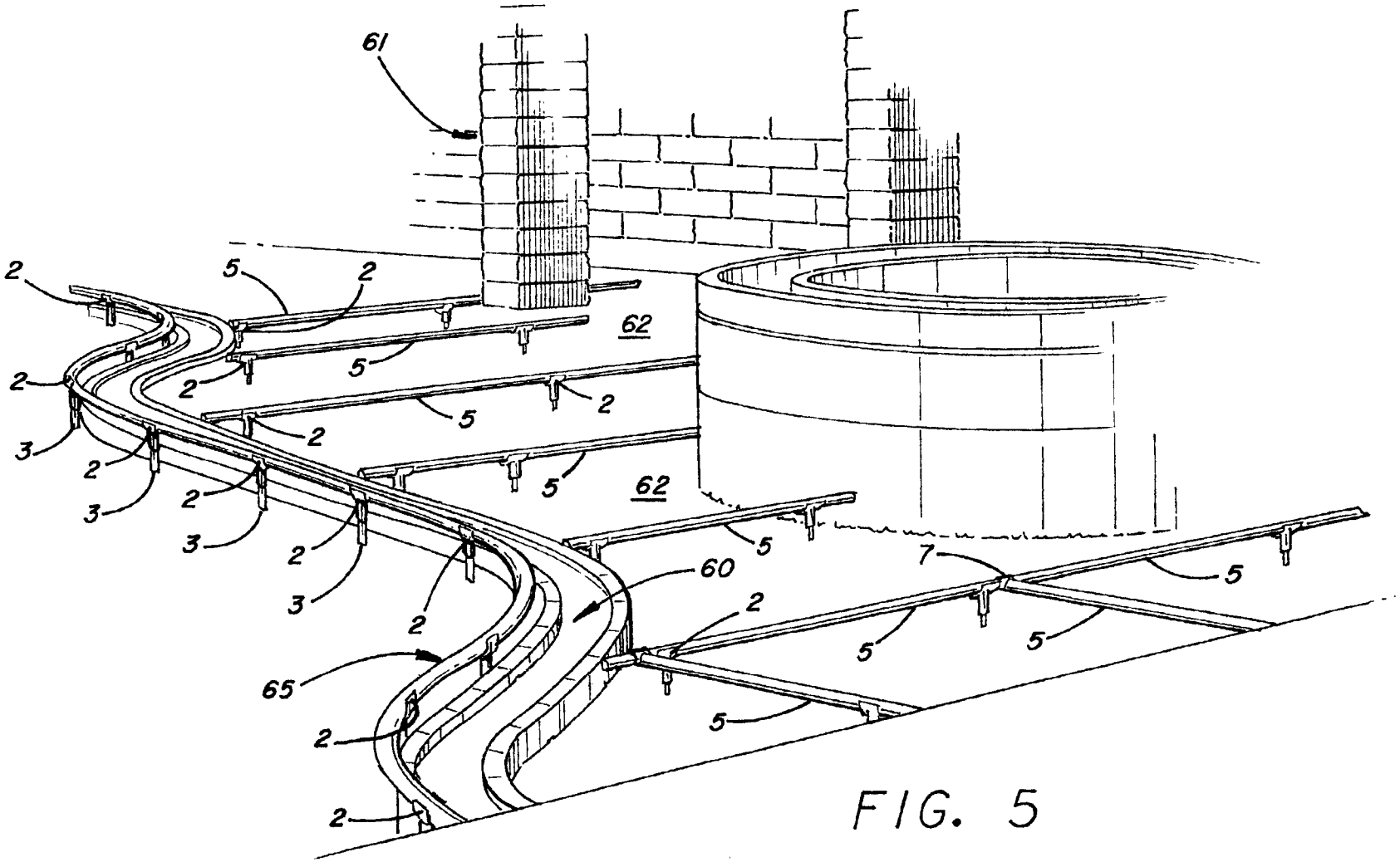
FIG. 5 is a perspective view illustrating the screed ski system of FIG. 1 used in conjunction with an arcuate screed ski structure of the present invention.

Referring to FIG. 5, which is a perspective view illustrating the screed ski system of FIG. 1 used in conjunction with an arcuate screed ski structure of the present invention, the above described screed ski system of FIG. 1 is shown assembled in an area having its right side bounded by a wall 61 and its left side bounded by a serpentine concrete masonry unit (CMU) perimeter stem wall 60. A number of rebar stakes 3 have been pounded into the ground to a suitable height on the left side of the perimeter stem wall 60 and circlip saddles 2 have been placed on the upper end of each rebar stake 3. One-half inch Schedule 40 PVC pipe has been flexed to follow the serpentine contour and elevation requirements of perimeter stem wall 60 and provides a curved screed ski and a layout perimeter along which to slide the screed bar 10 of FIG. 1 The screed bar 10 can be supported by a suitable length of PVC pipe 65 and various EMT tubing sections 5 in order to accomplish the desired screeding of aggregate material (not shown) dumped into the region between perimeter stem 60 and wall 61. Note that the serpentine PVC pipe 65 acts both as the screed ski and also has a perimeter outline to define where the edges of the rectangular concrete masonry units or cinder blocks are positioned in order to create the desired serpentine curve.

Figure 6A:
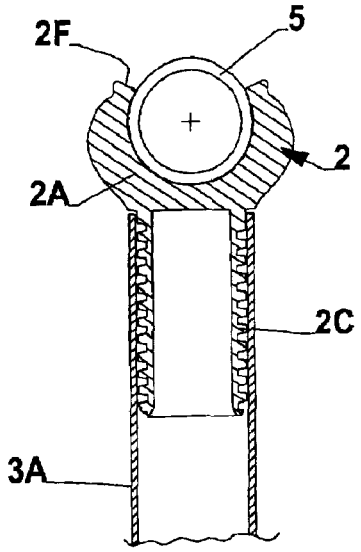
FIG. 6A is a section view of an alternate structure showing a screed ski circlip saddle of FIG. 1 mounted on a metal tubing stake rather than a rebar stake.
Figure 6B:
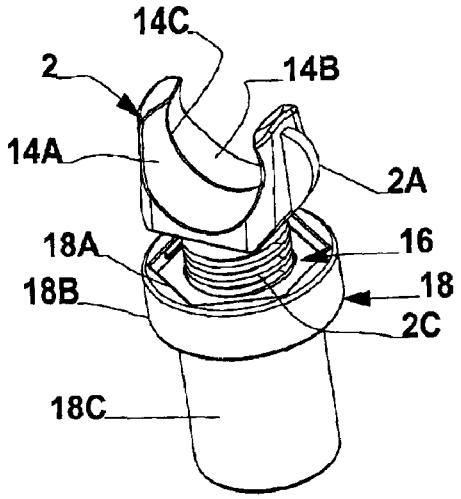
FIG. 6B is a perspective view showing a screed ski circlip saddle of FIG. 1 mounted in a rotatable cup capturing a hex nut for precisely adjusting the elevation of the circlip saddle.
Figure 6C:
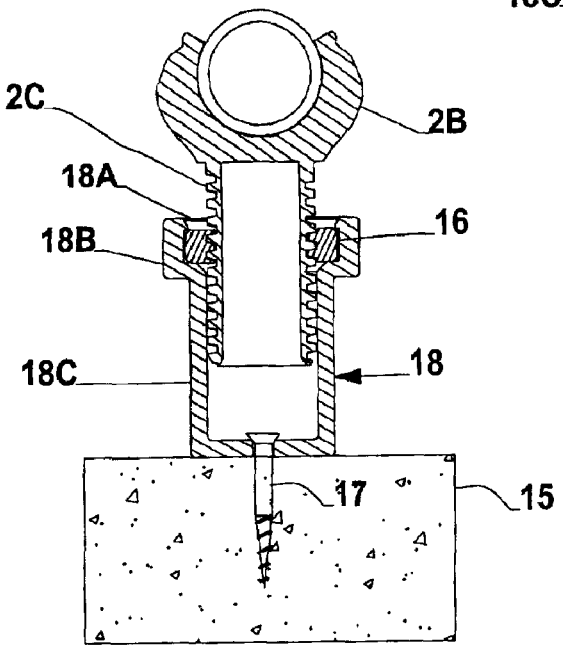
FIG. 6C is a section view showing a screed ski circlip saddle of FIG. 1 with a hex nut mounted in a cup attached to a substrate.
Figure 7A:
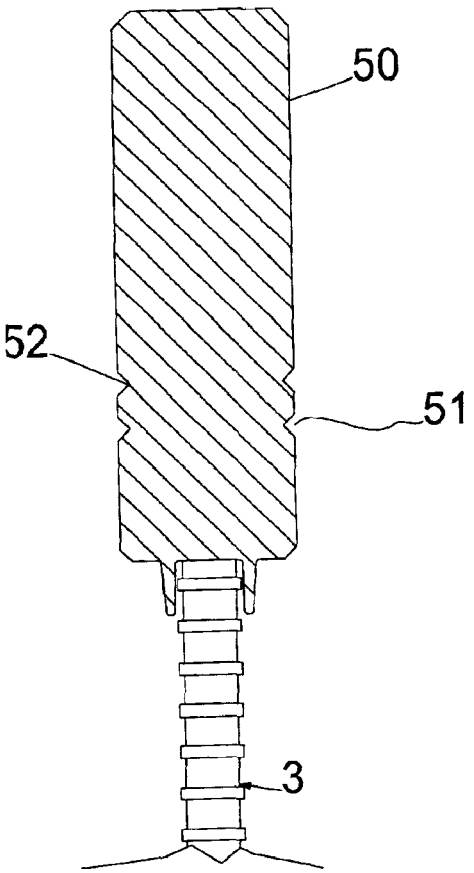
FIG. 7A is a section view of the pounder 50 of FIG. 4 being used to drive in a rebar stake.
Figure 7B:
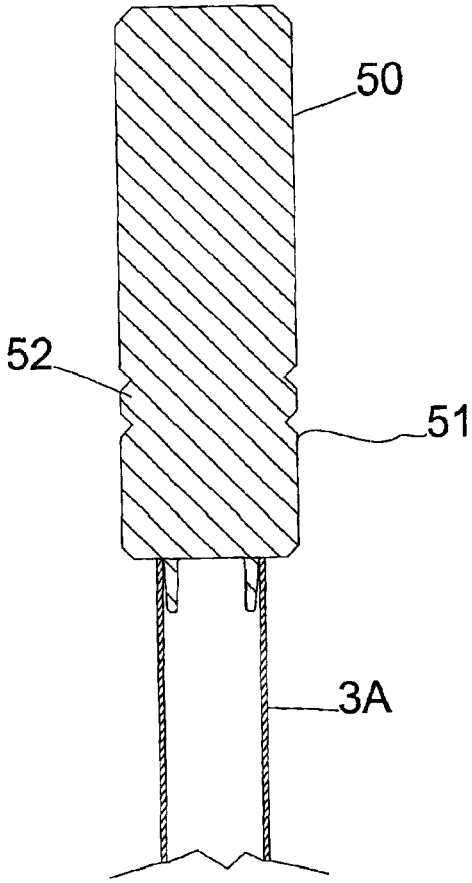
FIG. 7B is a section view of the pounder 50 of FIG. 4 being used to drive in an EMT stake.

Referring to FIG. 6A, the shank 2C of circlip saddle 2 can be inserted into the open upper end of a stake 3A comprised of a suitable length of EMT ¾ inch tube pounded into the ground. However, rebar stakes have certain advantages compared to EMT tube stakes. Rebar stakes are suitably rigid for hard or rocky soils, whereas EMT stakes are not. Rebar is very inexpensive and is readily available at most sites and can be purchased at most building materials stores or the line. Because rebar is composed of relatively soft metal, the upper end of a rebar stake peens over well with the pounding tool 50 so that the upper end of the rebar stake 3 fits precisely into the opening 2E in the bottom of the circlip saddle 2.

Referring to FIGS. 1, 6B and 6C, another configuration is shown for mounting a circlip saddle 2 on a solid surface 15. In this configuration, a hex nut 16 is "captured" in a mating hex recess 18A in the upper section 18B of a cup 18 into which the threaded shank 2C is inserted after hex nut 16 is threaded on to shank 2C thereon. The lower portion 18C of cup 18 has previously been fastened by means of a concrete screw 17 (or a nail, bolt, or other fastening device) to a solid substrate or support 15, which can be horizontal, steeply pitched, or even vertical. Precise adjustments in the elevation of the channel 14A,B,C then can be made by simply rotating cup 18 to raise or lower the position of circlip saddle 2 on the solid surface material 15. Cups 18 could be made of sheet metal, and could be used in conjunction with the pouring of concrete over steel decking in commercial construction, by welding or bolting the cups 18 to the steel picking.

While the invention has been described with reference to several particular embodiments thereof, those skilled in the art will be able to make the various modifications to the described embodiments of the invention without departing from the true spirit and scope of the invention. It is intended that all elements or steps which are insubstantially different or perform substantially the same function in substantially the same way to achieve the same result as what is claimed are within the scope of the invention. For example, it is not essential that the ends of the various sections of screed ski tubing be connected together as long as they overlap in a way that allows the screed bar 10 to slide smoothly from one screed ski tube sections to another. The straight couplers 6, the Tee couplers 7 and the 90 degree couplers 8 could use various other frictional end joining sections than the circular rounded ridges 6C disclosed in the drawings. For example, male and female swaged end joining sections could be utilized in conjunction with corresponding male and female end sections of suitable screed ski tube sections 5. As another example, male and female threaded end joining sections could be utilized in conjunction with corresponding male and female end sections of suitable screed ski tube sections 5. The circlip saddles 5 could be provided with interior threads to mate with stakes having corresponding threads.

What is claimed is:

1. A screed ski system comprising:

(a) a plurality of stakes anchored in material on which aggregate material is to be screeded;

(b) a plurality of circlip saddles each supported by a corresponding stake, wherein each circlip saddle includes a shank and a pair of opposed arms attached to an upper end of the shank, the arms forming a channel in which a section of the screed ski material can be retained by upper tip portions of the arms;

(c) a plurality of sections of screed ski material snap-fit into and supported by the circlip saddles, wherein uppermost tip portions of the arms are forced apart by the section of screed ski material and then resiliently close back over the section of screed ski material to accomplish the snap-fit as the sections of screed ski material are forced into the channel; and (d) a plurality of couplers each coupling adjacent ends of the various sections of screed ski material together, wherein the channel includes a reduced diameter center portion symmetrically dividing two frusto-conical surface portions and which are tapered so as to allow the circlip saddles to effectively grip a section of screed ski material when the shank is inclined with respect to a line perpendicular to a longitudinal axis of the screed ski material.

2. A screed ski system comprising:

(a) a plurality of stakes anchored in material on which aggregate material is to be screeded;

(b) a plurality of circlip saddles each supported by a corresponding stake, wherein each circlip saddle includes a shank and a pair of opposed arms attached to an upper end of the shank, the arms forming a channel in which a section of the screed ski material can be retained by upper tip portions of the arms;

(c) a plurality of sections of screed ski material snap-fit into and supported by the circlip saddles, wherein uppermost tip portions of the arms are forced apart by the section of screed ski material and then resiliently close back over the section of screed ski material to accomplish the snap-fit as the sections of screed ski material are forced into the channel;

(d) a plurality of couplers each coupling adjacent ends of the various sections of screed ski material together; and (e) a nut threaded onto the shank of the circlip saddle, wherein an outer surface of the shank is threaded, the nut being captured in an upper enlarged portion of a retainer cup having a lower portion for attachment to a solid support surface such that rotating the retainer cup rotates the nut and precisely raises or lowers the circlip saddle relative to the solid support surface.

* * * * *